US006406564B1

(12) United States Patent
Muraki et al.

(10) Patent No.: US 6,406,564 B1
(45) Date of Patent: Jun. 18, 2002

(54) ELECTRIC WELDED BOILER STEEL PIPE

(75) Inventors: Taro Muraki; Yasushi Hasegawa, both of Futtsu; Junichi Okamoto, Kimitsu, all of (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/622,083

(22) PCT Filed: Dec. 14, 1999

(86) PCT No.: PCT/JP99/07018

§ 371 (c)(1),
(2), (4) Date: Aug. 10, 2000

(87) PCT Pub. No.: WO00/36173

PCT Pub. Date: Jun. 22, 2000

(30) Foreign Application Priority Data

Dec. 14, 1998 (JP) ..... 10-354327
Oct. 26, 1999 (JP) ..... 11-304705

(51) Int. Cl.[7] ..... C22C 38/18; C22C 38/02; C22C 38/04

(52) U.S. Cl. ..... 148/333; 148/334; 148/335; 148/909; 420/104; 138/171

(58) Field of Search ..... 420/8, 104; 148/320, 148/333, 334, 909; 138/171

(56) References Cited

FOREIGN PATENT DOCUMENTS

| | | | |
|---|---|---|---|
| JP | 57-131349 | | 8/1982 |
| JP | 57-131350 | | 8/1982 |
| JP | 60-116722 A | * | 6/1985 |
| JP | 61-166916 | | 7/1986 |
| JP | 61-279658 A | * | 12/1986 |
| JP | 62-54062 | | 3/1987 |
| JP | 63-18038 | | 1/1988 |
| JP | 63-62848 | | 3/1988 |
| JP | 63-206452 A | * | 8/1988 |
| JP | 1-29853 | | 1/1989 |
| JP | 1-68451 | | 3/1989 |
| JP | 2-217438 | | 8/1990 |
| JP | 2-217439 | | 8/1990 |
| JP | 3-64428 | | 3/1991 |
| JP | 3-87332 | | 4/1991 |
| JP | 4-268040 | | 9/1992 |
| JP | 5-263193 A | * | 10/1993 |
| JP | 6-10041 | | 1/1994 |
| JP | 7/59740 | | 6/1995 |
| JP | 8-134584 | | 5/1996 |
| JP | 8-225833 | | 9/1996 |
| JP | 10-1737 A | * | 1/1998 |

* cited by examiner

*Primary Examiner*—Deborah Yee
(74) *Attorney, Agent, or Firm*—Kenyon & Kenyon

(57) ABSTRACT

This invention provides a boiler steel pipe that exhibits a high creep rupture strength on a high-temperature high-pressure side and is excellent in electric weldability, and an electric welded boiler steel pipe having fewer defects at an electric welded portion. The boiler steel contains, in terms of wt %, C: 0.01 to 0.20%, Si: 0.01 to 1.0% and Mn: 0.10 to 2.0%, contains further Cr: 0.5 to 3.5%, and limits p≦0.030%, S≦0.010% and 0≦0.20%, wherein a weight ratio of (Si %)/(Mn %) or (Si %)/(Mn %+Cr %) is from 0.005 to 1.5, the balance Fe and unavoidable impurities, and the melting point of the mixed oxide of $SiO_2$ and MnO, or $SiO_2$, MnO and $Cr_2O_3$, is not higher than 1,600° C. The oxide that would otherwise result in the defects of the electric welded portion is molten and squeezed out as slag components. Therefore, a boiler steel excellent in electric weldability and the electric welded boiler steel pipe having fewer welding defects, excellent in creep rupture strength and toughness, and using the former, can be obtained.

6 Claims, 2 Drawing Sheets

ELECTRIC WELDED BOILER STEEL PIPE

TECHNICAL FIELD

This invention relates to steel for a boiler and an electric welded boiler steel pipe using the boiler steel. More particularly, this invention relates to steel, for use in a high-temperature/high-pressure environment, that is excellent in creep rupture strength and electric weldability, and an electro-unite boiler steel pipe that has excellent properties at the electrically welded portions.

BACKGROUND ART

An austenite type stainless steel, a high Cr ferrite steel having a Cr content of 9 to 12% (the term "%" means "% by weight"; hereinafter the same), a low Cr ferrite steel having a Cr content of not greater than 2.25% or a carbon steel has been generally used for high-temperature- and high-pressure-resistant members for boilers and for chemical industry and nuclear facilities. These steels are selected appropriately in consideration of the environment of use of the members such as the temperature, the pressure, etc, and economy.

Among these materials, a low Cr ferrite steel having the Cr content of not greater than 2.25% has the following features. Since this steel contains Cr, it is superior to carbon steel in oxidation resistance, high-temperature corrosion resistance and high-temperature strength. A low Cr ferrite steel is far more economical than an austenite type stainless steel. It has a small coefficient of thermal expansion and does not undergo stress corrosion cracking. It is also more economical and more excellent in toughness, heat conductivity and weldability than a high Cr ferrite steel.

Typical examples of such a low Cr ferrite steel are STBA20, STBA22, STBA23, STBA24, etc, that are stipulated by JIS. These low Cr ferrite steels are ordinarily called generically "Cr—Mo steels". The low Cr ferrite steels, to which V, Nb, Ti, Ta or B is added as a precipitation hardening element to improve the high-temperature strength, are proposed in Japanese Unexamined Patent Publication (Kokai) Nos. 57-131349, 57-131350, 61-166916, 62-54062, 63-18038, 63-62848, 1-68451, 1-29853, 3-64428, 3-87332, and so forth.

A 1Cr-1Mo-0.25V steel as a turbine material and a 2.25Cr-1Mo—Nb steel as a structural material of a fast breeder reactor are well known as the precipitation hardening type low Cr ferrite steel. However, these low Cr ferrite steels are inferior to the high Cr ferrite steel and the austenite type stainless steel in the oxidation resistance and the corrosion resistance at high temperatures, and have lower high-temperature strength. Therefore, these steels involve the problems when used at a temperature higher than 550° C.

To improve the creep strength at a temperature of 550° C. or above, Japanese Unexamined Patent Publications (Kokai) No. 2-217438 and No. 2-217439 propose low Cr ferrite steels to which large amounts of W are added or Cu and Mg are added compositely. Japanese Unexamined Patent Publication (Kokai) No. 4-268040 proposes low Cr ferrite steel to which a trace amount of B is added after limiting the N content in order to improve the creep strength at a temperature of 550° C. or above and to restrict the drop of toughness resulting from the increase of the strength.

When these materials are electrically welded, a large number of high-melting-point oxides are formed at the electric welded portion and are entrapped into the inner surface at the time of electric welding. Consequently, a defect area ratio of the electric welded portion, as one of the properties of the electric welded portion, is high, and the properties of the electric welded portion, such as the creep rupture strength, toughness, etc., cannot be satisfied in a high-temperature environment of 550° C. or above. Therefore, these materials cannot be said to be suitable materials for electric welded steel pipes. For these reasons, the low Cr ferrite steel which is capable to use at a temperature of 550° C. or above can be nominated a seamless steel pipe. However, the production cost of the seamless steel pipe is high, and this material is not a useful material from the aspect of economy.

In view of the technical background described above, it is an object of the present invention to provide a steel for a boiler that is an ordinary steel not containing Cr (ordinary boiler steel) and a low Cr ferrite steel having a Cr content of not greater than 3.5% (low Cr ferrite type boiler steel), exhibits a high creep rupture strength after use at a high temperature for a long time, is particularly excellent in electric weldability with fewer defects formed at an electric welded portion, and an electric welded boiler steel pipe having fewer defects at the electric welded portion and produced by using the steel.

DISCLOSURE OF THE INVENTION

The present invention relates to an electric welded boiler steel pipe that can be used at a temperature of 550° C. or above, can be produced at a lower cost of production but has a better economical effect than conventional seamless steel pipes.

The inventors of the present invention have conducted intensive studies to obtain a steel and a steel pipe having fewer defects generated at an electric welded portion and having better properties, such as creep rupture strength and toughness, then in ordinary boiler steels and low Cr ferrite type boiler steels. As a result, the present inventors have found that a binary system mixed oxide of $SiO_2$ and MnO formed at the time of electric welding exerts a great influence on the welding defects in ordinary boiler steels, and a ternary system mixed oxide of $SiO_2$, MnO and $Cr_2O_3$ exerts a great influence on the occurrence of the welding defects in low Cr ferrite type boiler steels. The present inventors have clarified further that when the melting points of the respective mixed oxides are lowered, the oxides are molten at the time of electric welding and can be squeezed out as slag components from the weld portion, and this reduces the welding defects of the electric welded portion resulting from the mixed oxides.

The present invention was completed on the basis of the finding described above. As to the ordinary boiler steels, the relational formula of Si and Mn is derived on the basis of the binary system phase diagram, and the respective contents are stipulated to lower the melting point of the binary system mixed oxide of $SiO_2$ and MnO. As to the low Cr ferrite type boiler steels, the relational formula of Si, Mn and Cr is derived on the basis of the ternary system phase diagram of $SiO_2$, MnO and $Cr_2O_3$, and the respective contents are stipulated to lower the melting points of the ternary system mixed oxide of $SiO_2$, MnO and $Cr_2O_3$. In this way, the present invention reduces number of the welding defects in the electric welded portion, and prevents deterioration of the creep characteristics and toughness of the electric welded portion.

In other words, the gist of the present invention resides in the following points.

(1) A boiler steel excellent in electric weldability, containing, in terms of wt %:

C: 0.01 to 0.20%,

Si: 0.01 to 1.0%, and

Mn: 0.10 to 2.0%, and limiting the following elements:

P: to not greater than 0.030%,

S: to not greater than 0.010%, and

O: to not greater than 0.020%, wherein a weight ratio of Si and Mn ((Si %)/(Mn %)) is from 0.005 to 1.5;

the balance Fe and unavoidable impurities; and a melting point of a mixed oxide of $SiO_2$ and MnO formed at the time of electric welding is not higher than 1,600° C.

(2) A boiler steel excellent in electric weldability, containing, in terms of wt %:

C: 0.01 to 0.20%,

Si: 0.01 to 1.0%,

Mn: 0.10 to 2.0%,

Nb: 0.001 to 0.5%,

V: 0.02 to 1.0%,

N: 0.001 to 0.08%,

B: 0.0003 to 0.01%, and

Al: not greater than 0.01%, containing further at least one of the following elements:

Mo: 0.01 to 2.0%, and

W: 0.01 to 3.0%, and limiting the following elements:

P: to not greater than 0.030%,

S: to not greater than 0.010%, and

O: to not greater than 0.020%;

wherein a weight ratio of Si and Mn ((Si %)/(Mn %)) is from 0.005 to 1.5;

the balance Fe and unavoidable impurities; and a melting point of a mixed oxide of $SiO_2$ and MnO formed at the time of electric welding is not higher than 1,6000° C.

(3) A boiler steel excellent in electric weldability, containing, in terms of wt %:

C: 0.01 to 0.20%;

Si: 0.01 to 1.0%,

Mn: 0.10 to 2.0%, and

Cr: 0.5 to 3.5; and limiting the following elements:

P: to not greater than 0.030%,

S: to not greater than 0.010%, and

O: to not greater than 0.020%;

wherein a weight ratio of Si, Mn and Cr ((Si %)/(Mn+Cr %)) is from 0.005 to 1.5;

the balance Fe and unavoidable impurities; and a melting point of a mixed oxide of $SiO_2$, MnO and $Cr_2O_3$ formed at the time of electric welding is not higher than 1,600° C.

(4) A boiler steel excellent in electric weldability, containing, in terms of wt %:

C: 0.01 to 0.20%,

Si: 0.01 to 1.0%,

Mn: 0.10 to 2.0%,

Cr: 0.5 to 3.5%,

Nb: 0.001 to 0.5%,

V: 0.02 to 1.0%,

N: 0.001 to 0.08%,

B: 0.0003 to 0.01%, and

Al: not greater than 0.01%; containing further at least one of the following components;

Mo: 0.01 to 2.0%, and

W: 0.01 to 3.0%; and limiting the following elements:

P: to not greater than 0.030%,

S: to not greater than 0.010%, and

O: to not greater than 0.020%;

wherein a weight ratio of Si, Mn and Cr ((Si %)/(Mn %+Cr %)) is from 0.005 to 1.5;

the balance Fe and unavoidable impurities; and a melting point of a mixed oxide of $SiO_2$, MnO and $Cr_2O_3$ formed at the time of electric welding is not higher than 1,600° C.

(5) A boiler steel excellent in electric weldability, according to the paragraph (2) or (4), which further contains, in terms of wt %:

Ti: 0.001 to 0.05%.

(6) A boiler steel excellent in electric weldability, according to the paragraph (2) or (4), which further contains at least one of the following elements:

Cu: 0.1 to 2.0%,

Ni: 0.1 to 2.0%, and

Co: 0.1 to 2.0%.

(7) A boiler steel excellent in electric weldability, according to the paragraph (2) or (4), which further contains:

Ti: 0.001 to 0.05%, and at least one of the following elements:

Cu: 0.1 to 2.0%,

Ni: 0.1 to 2.0%, and

Co: 0.1 to 2.0%.

(8) A boiler steel excellent in electric weldability, according to any of the paragraphs (2) and (4) through (7), which further contains, in terms of wt %, 0.001 to 0.2% of at least one of La, Ca, Y, Ce, Zr, Ta, Hf, Re, Pt, Ir, Pd and Sb.

(9) An electric welded boiler steel pipe having fewer defects at electric welded portions and excellent in creep rupture strength and toughness, containing, in terms of wt %;

C: 0.01 to 0.20%,

Si: 0.01 to 1.0%, and

Mn: 0.10 to 2.0%; and limiting the following elements:

P: to not greater than 0.030%,

S: to not greater than 0.010%, and

O: to not greater than 0.020%;

wherein a weight ratio of Si and Mn ((Si %)/(Mn %)) is from 0.005 to 1.5;

the balance Fe and unavoidable impurities; and an area ratio of a binary system mixed oxide of $SiO_2$ and MnO at electric welded portions is not greater than 0.1%.

(10) An electric welded boiler steel pipe having fewer defects at electric welded portions and excellent in creep rupture strength and toughness, containing, in terms of wt %:

C: 0.01 to 0.20%,

Si: 0.01 to 1.0%,

Mn: 0.10 to 2.0%,

Nb: 0.001 to 0.5%,

V: 0.02 to 1.0%,

N: 0.001 to 0.08%,

B: 0.0003 to 0.01%, and

Al: not greater than 0.01%; containing further at least one of the following elements:

Mo: 0.01 to 2.0%, and

W: 0.01 to 3.0%; and limiting the following elements:

P: to not greater than 0.030%,

S: to not greater than 0.010%, and

O: to not greater than 0.020%;

wherein a weight ratio of Si and Mn ((Si %)/(Mn %)) is from 0.005 to 1.5;

the balance Fe and unavoidable impurities; and an area ratio of a binary system mixed oxide of $SiO_2$ and MnO at the electric welded portions is not greater than 0.1%.

(11) An electric welded boiler steel pipe having fewer defects at electric welded portions and excellent in creep rupture strength and toughness, containing in terms of wt %:

C: 0.01 to 0.20%,

Si: 0.01 to 1.0%,

Mn: 0.10 to 2.0%, and

Cr: 0.5 to 3.5%; limiting the following elements:

P: to not greater than 0.030%,

S: to not greater than 0.010%, and

O: to not greater than 0.020%;

wherein a weight ratio of Si and Mn plus Cr ((Si %)/(Mn %+Cr %)) is from 0.005 to 1.5;

the balance Fe and unavoidable impurities; and an area ratio of a ternary system mixed oxide of $SiO_2MnO$ and $Cr_2O_3$ at the electric welded portions is not greater than 0.1%.

(12) An electric welded boiler steel pipe having fewer defects at electric welded portions and excellent in creep rupture strength and toughness, containing, in terms of wt %:

C: 0.01 to 0.20%,

Si: 0.01 to 1.0%,

Mn: 0.10 to 2.0%,

Cr: 0.5 to 3.5%,

Nb: 0.001 to 0.5%,

V: 0.02 to 1.0%,

N: 0.001 to 0.08%,

B: 0.0003 to 0.01%, and

Al: not greater than 0.01%; containing further at least one of the following elements:

Mo: 0.01 to 2.0%, and

W: 0.01 to 3.0%; limiting the following elements:

P: to not greater than 0.030%,

S: to not greater than 0.010%, and

O: to not greater than 0.020%;

wherein a weight ratio of Si and Mn plus Cr ((Si %)/(Mn %+Cr %)) is from 0.005 to 1.5;

the balance Fe and unavoidable impurities; and an area ratio of a ternary system mixed oxide of $SiO_2$, MnO and $Cr_2O_3$ is not greater than 0.1%.

(13) An electric welded boiler steel pipe having fewer defects at electric welded portions and excellent in creep rupture strength and toughness, according to the paragraph (10) or (12), which further contains, in terms of wt %, the following element as a base material component:

Ti: 0.001 to 0.05%.

(14) An electric welded boiler steel pipe having fewer defects at electric welded portions and excellent in creep rupture strength and toughness, according to the paragraph (10) or (12), which further contains, in terms of wt %, at least one of the following elements as a base metal component:

Cu: 0.1 to 2.0%,

Ni: 0.1 to 2.0%, and

Co: 0.1 to 2.0%.

(15) An electric welded boiler steel pipe having fewer defects at electric welded portions and excellent in creep rupture strength and toughness, according to the paragraph (10) or (12) which further contains, in terms of wt %, the following element as a base metal component:

Ti: 0.01 to 0.05%, and contains further at least one of the following elements:

Cu: 0.1 to 2.0%,

Ni: 0.1 to 2.0%, and

Co: 0.1 to 2.0%.

(16) An electric welded boiler steel pipe having fewer defects at electric welded portions and excellent in creep rupture strength and toughness, according to any of the paragraphs (10) and (12) to (15), which further contains, in terms of wt %, 0.001 to 0.2% of at least one of La, Ca, Y, Ce, Zr, Ta, Hf, Re, Pt, Ir, Pd and Sb as a base metal component.

BEST MODE FOR CARRYING OUT THE INVENTION

Figure 1:
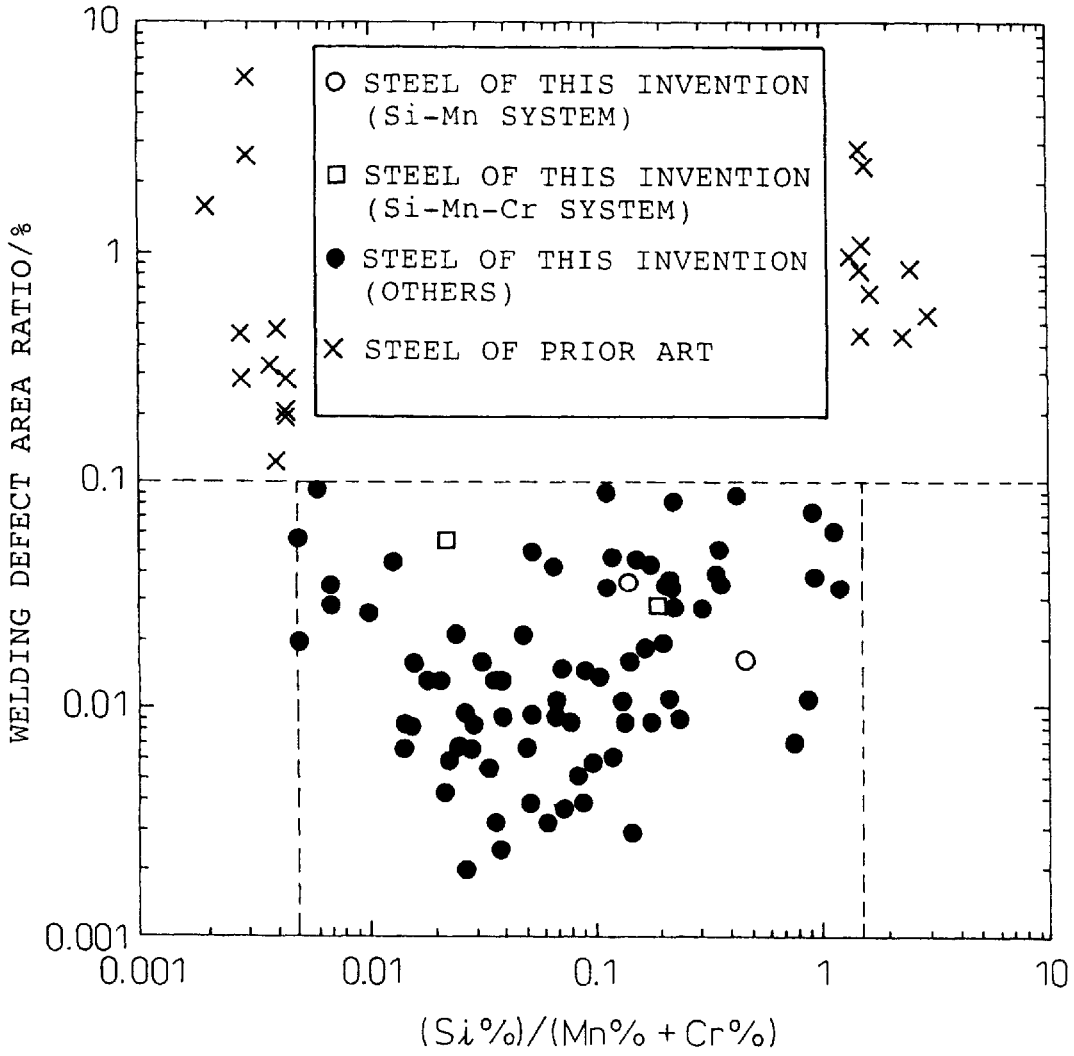
FIG. 1 is a graph showing the relationship between a welding defect area ratio and Si, Mn and Cr contents.

Hereinafter, the present invention will be explained in detail.

The feature of the present invention resides in the following point. Particularly, when an ordinary boiler steel and a low Cr ferrite type boiler steel are electrically welded, the melting point of a binary system mixed oxide of $SiO_2$ and MnO and the melting point of a ternary system mixed oxide of $SiO_2$, MnO and $Cr_2O_3$, that greatly affect the defect and properties of the electric welded portion, are controlled by the relational formula of the addition amounts of Si and Mn, that is stipulated on the basis of the phase diagram of the binary system oxide, and the relational formula of the addition amounts of Si, Mn and Cr, that is stipulated on the basis of the phase diagram of the ternary system oxide, so that the welding defect area ratio of the electric welded portion can be extremely reduced and the deterioration of the creep characteristics and toughness at the electric welded portions can be prevented.

The present invention is directed to ordinary boiler steels, low Cr ferrite type boiler steels and electric welded boiler steel pipes using these steels. The reasons why the component compositions of these steels are stipulated as described above are as follows.

Carbon (C) forms carbides with Cr, Fe, W, Mo, V and Nb and contributes to the improvement of the high-temperature strength. Carbon itself stabilizes the texture as an austenite-stabilizing element.

The steels according to the present invention are converted to a mixed structure of ferrite, martensite, bainite and pearlite when the steels are annealed and tempered. The C content is important for controlling the balance of these structures.

When the C content is less than 0.01%, the precipitation amount of the carbides is not sufficient, and the amount of δ-ferrite becomes excessive great, so that both strength and toughness are deteriorated. When the C content exceeds 0.20%, on the other hand, the carbides precipitate excessively. In consequence, the steel is remarkably hardened, and formability and weldability are deteriorated. Therefore, the C content is limited to 0.01% to 0.20%.

Silicon (Si) is the element that functions as a deoxidizer and also improves the steam oxidation resistance of the steels. When the Si content is less than 0.01%, the effect is not sufficient and when it exceeds 1.0%, toughness drops remarkably, and such a Si content is also detrimental to the creep rupture strength. Therefore, the Si content is limited to 0.01 to 1.0%.

Manganese (Mn) is the element that is necessary not only for deoxidation but also for keeping the strength. To obtain a sufficient effect, at least 0.10% of Mn must be added. When the Mn content exceeds 2.0%, the creep rupture strength drops in some cases. Therefore, the Mn content is limited to 0.10% to 2.0%.

Chromium (Cr) is an indispensable element for improving the oxidation resistance and the high-temperature corrosion resistance. When the Cr content is less than 0.5%, these effects cannot be obtained. When the Cr content exceeds 3.5%, however, toughness, weldability and heat conductivity drop with the result that the advantages of the low Cr ferrite steel are deteriorated. Therefore, the Cr content is limited to 0.5% to 3.5%.

Niobium (Nb) combines with C and N to form fine carbides and nitrides of Nb(C, N), and contributes to the improvement of the creep rupture strength. Nb forms stable fine precipitates particularly at 625° C. or below, and remarkably improves the creep rupture strength. Furthermore, Nb makes the crystal grains fine and is effective for improving toughness. However, these effects cannot be obtained when the Nb content is less than 0.001%. When the Nb content exceeds 0.5%, on the other hand, the steel becomes extremely hard, and toughness, formability and weldability drop. Therefore, the Nb content is limited to from 0.001% to 0.5%.

Vanadium (V) combines with C and N in the same way as Nb, forms fine carbides and nitrides of V(C, N), and contributes to the creep rupture strength on the high temperature side for a long time. When the V content is less than 0.02%, its effect is not sufficient. When V is added in an amount exceeding 1.0%, however, the precipitation amount of V(C, N) becomes excessive, and strength and toughness are deteriorated, on the contrary. Therefore, the V content is limited to from 0.02% to 1.0%.

Nitrogen (N) precipitates in the matrix as the solid solution, or the nitrides or carbon nitrides, mainly takes the form of VN, NbN or the respective carbon nitrides, and contributes to both solid solution hardening and precipitation hardening. In the present invention, N combines with Ti to form TiN and combines further with B and precipitates as BN. These nitrides contribute to the improvement of creep rupture strength. When the N content is less than 0.001%, it hardly contributes to strengthening and when it exceeds 0.08%, the drop of the base metal toughness and strength becomes remarkable. Therefore, the N content is limited to 0.001% to 0.08%.

Boron (B) is the element that is added to secure the following effects. Boron co-segregates with C and stabilizes fine carbides (concretely, $M_{23}C_6$ carbides). When low Cr ferrite steel is heated at a high temperature for a long time, W and Mo concentrate on the $M_{23}C_6$ carbide to change this carbide to a coarse $M_6C$ carbide and invite the drop of creep rupture strength and toughness. When B is added, however, $M_{23}C_6$ can be stabilized. In consequence, precipitation of the coarse carbide $M_6C$ can be restricted and the drop of creep strength can be limited. When the B content is less than 0.0003%, however, the effect described above cannot be obtained. When the B content exceeds 0.01%, on the other hand, B segregates excessively in the crystal grain boundary, and the carbides aggregate and becomes coarse in some cases, due to co-segregation with C, with the result that formability, toughness and weldability are remarkably deteriorated. Therefore, the B content is limited to 0.0003% to 0.01%.

Aluminum (Al) is effective as a deoxidizer. However, since high-temperature strength drops particularly when the Al content exceeds 0.01%, the Al content is limited to not greater than 0.01%.

Molybdenum (Mo) is the element that has the hardening functions by solid solution hardening and by precipitation of fine carbides, is effective for improving creep rupture strength, and can be contained, whenever necessary. However, when the Mo content is less than 0.01%, this effect cannot be obtained. When the Mo content exceeds 2.0%, the effect gets into saturation and moreover, weldability and toughness are deteriorated. When Mo is added, therefore, the addition amount is preferably from 0.01% to 2.0%. Incidentally, when Mo and W are added in combination, the strength of the steel can be improved much more than when the elements are added individually and particularly, high-temperature creep rupture strength can be improved.

Tungsten (W) is the element that exhibits hardening operations by solid solution hardening and by precipitation of fine carbides, and is effective for improving creep rupture strength. When the W content is less than 0.01%, these effects cannot be obtained. When the W content exceeds 3.0%, on the other hand, the steel is remarkably hardened with the drop of toughness, formability and weldability. Therefore, the W content is limited to from 0.01% to 3.0%. Incidentally, when W and Mo are added in combination, the strength improving effect of the steel becomes remarkable, as described above.

Phosphorus (P), sulfur (S) and oxygen (O) mix as impurity elements into the steel of the present invention. In order to exhibit the effects of the present invention, the upper limits of P, S and O are limited to 0.030%, 0.010% and 0.020%, respectively, because P and S lower strength, and O precipitates as oxides and lowers toughness.

Titanium (Ti) combines with C and N and forms Ti(C, N). Particularly because Ti has strong binding power with N, it is effective for fixing solid solution N. Though B, too, has the function of fixing solid solution N as will be described later, its binding form with C is remarkably different from that of Ti. In other words, B is likely to segregate into carbides containing Fe, Cr and W as the principal components, and when B exists in excess, B promotes, in some cases, aggregation and coarsening of these carbides. In contrast, Ti combines individually with C and undergoes composite precipitation as TiN but does not allow the further progress of aggregation and coarsening. Therefore, Ti is preferred in that it effectively fixes N and at the same time, does not affect phase stability of the carbides.

Furthermore, Ti improves hardenability by restricting the solid solution N amount, and also improves toughness and creep strength. However, these effects cannot be obtained when the Ti content is less than 0.001%. When the Ti content exceeds 0.05%, on the other hand, the precipitation amount of Ti(C, N) becomes so great that toughness is remarkably deteriorated. Therefore, the Ti content is preferably from 0.001% to 0.05%.

All of copper (Cu), nickel (Ni) and cobalt (Co) are strong austenite stabilizing elements. They are necessary, and useful, for obtaining the hardened structure or the hardened-tempered structure particularly when large amounts of ferrite stabilizing elements, that is, Cr, W, Mo, Ti, Si, and so forth, are added. At the same time, Cu is useful for improving the high-temperature corrosion resistance, Ni, for improving toughness, and Co, for improving strength. When their contents are not greater than 0.1%, the effect is not sufficient, and when they are added in the amounts exceeding 2.0%, embrittlement, resulting from precipitation of coarse inter-metallic compounds or segregation into the grain boundary, is not avoidable. Therefore, the Cu, Ni and Co contents are limited to 0.1% to 2.0%, respectively.

All of lanthanum (La), calcium (Ca), yttrium (Y), cerium (Ce), zirconium (Zr), tantalum (Ta), hafnium (Hf), rhenium (Re), platinum (Pt), iridium (Ir), palladium (Pd) and antimony (Sb) are added, whenever necessary, to control the forms of the impurity elements (P, S, O) and their precipitates (inclusions). When at least one of these elements is added in the amount of at least 0.001%, the impurities described above can be fixed as stable and harmless precipitates, and strength and toughness can be improved. When the addition amount is less than 0.001%, the effect cannot be obtained, and when the amount exceeds 0.2%, the amount of the inclusions increase and toughness is deteriorated, to the contrary. Therefore, the contents of these elements are limited to from 0.001 to 0.2%.

The present invention stipulates the components of the ordinary boiler steels and the low Cr ferrite type boiler steels as described above. Furthermore, to reduce the defects occurring at the electric welded portions and to improve creep rupture strength and toughness, the present invention stipulates the Si and Mn contents as the formation elements of a binary system mixed oxide of $SiO_2$ and MnO for the ordinary boiler steels (Si-Mn component system) by the following formula (1), and stipulates also the Si, Mn and Cr contents as the formation elements of a ternary system mixed oxide of $SiO_2$, MnO and $Cr_2O_3$ for the low Cr ferrite type boiler steels (Si—Mn—low Cr component system) by the following formula (2).

$$0.005 \leqq (\text{Si }\%)/(\text{Mn }\%) \leqq 1.5 \quad (1)$$

$$0.005 \leqq (\text{Si }\%)/(\text{Mn}+\text{Cr }\%) \leqq 1.5 \quad (2)$$

where (Si %), (Mn %) and (Cr %) represent the Si, Mn and Cr contents, respectively.

The results of the experiments conducted by the present inventors have revealed that the binary system mixed oxide of $SiO_2$ and MnO a exerts great influence on the occurrence of the defects in the ordinary boiler steels (Si—Mn component system) while the ternary system mixed oxide of $SiO_2$, MnO and $Cr_2O_3$ does in the low Cr ferrite type boiler steels (Si—Mn-low Cr component system), but when the melting points of these mixed oxides are lower than 1,600° C., these oxides do not remain as the oxides in the electric welded portions during electric welding, but are molten and squeezed out as slag components, so that the weld defects of the electric welded portions do not occur so easily.

When the phase diagram of these oxides is looked-up, the melting point of the mixed oxide becomes lower when the $SiO_2$ content becomes greater, and becomes higher when the MnO and/or $Cr_2O_3$ content becomes greater. In view of this fact, the present invention controls the formation of the mixed oxides, that greatly affect the defects and properties of the electric welded portions, by limiting the addition amounts of Si, Mn and Cr as the formation elements of $SiO_2$, MnO and $Cr_2O_3$, by the aforementioned formula (1) for the ordinary boiler steel and by the formula (2) for the low Cr ferrite type boiler steel.

Figure 2:
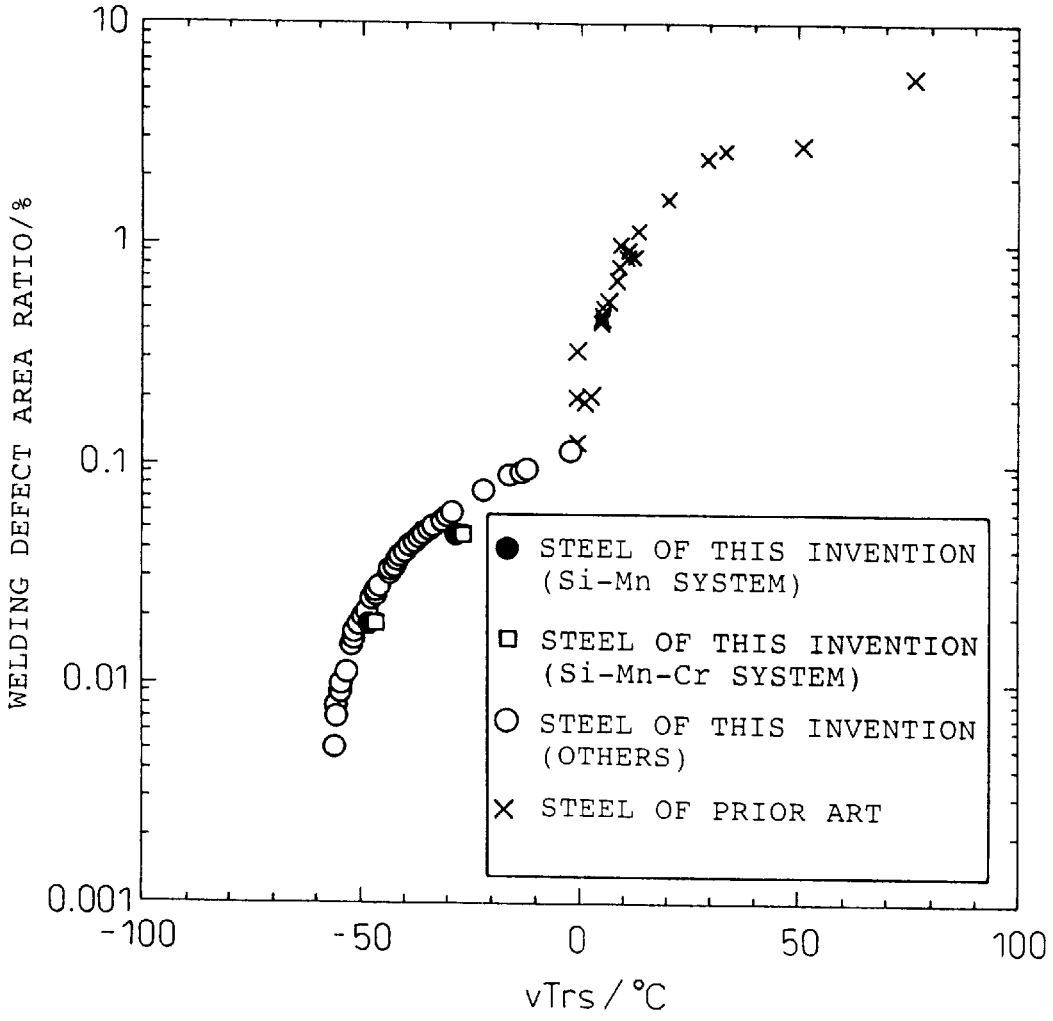
FIG. 2 is a graph showing the relationship between the welding defect area ratio and toughness.

FIG. 1 shows the relationship between (Si %)/(Mn %) or (Si %)/(Mn %+Cr %) and the welding defect area ratio of the electric welded portion in both ordinary boiler steel and low Cr ferrite type boiler steel in the steels according to the present invention in comparison with the steels according to the prior art. FIG. 2 shows the relationship between the toughness of the electric welded portion and the welding defect area ratio at that time. Here, the welding defect area ratio of the electric welded portion is calculated by observing the electric welded portion by an optical microscope, measuring the total area of the mixed oxide consisting mainly of $SiO_2$ and MnO for the ordinary boiler steel and $SiO_2$, MnO and $Cr_2O_3$ for the low Cr ferrite type boiler steel, and calculating the area ratio per unit area to obtain the welding defect area ratio. Toughness is measured by collecting a Charpy test specimen in a C direction (circumferential direction) of the electric welded portion, and conducting the Charpy test at 100° C.

As shown in FIGS. 1 and 2, when the value of (Si %)/(Mn %) or (Si %)/(Mn %+Cr %) represented by the formula (1) or (2) is less than 0.005, the oxide of MnO or/and $Cr_2O_3$ remains at the electric welded portion and results in the welding defect. Therefore, creep rupture strength and toughness of the electric welded portion drop. When the value of the formulas exceeds 1.5, the $SiO_2$ oxide remains at the electric welded portion and results in the welding defect. Therefore, creep rupture strength and toughness of the electric welded portion drop, too. Therefore, the upper and lower limit values of the formula (1) and (2) are limited to 1.5 and 0.005, respectively.

The area ratio of the binary system mixed oxide of $SiO_2$ and MnO in the electric welded portion must be not greater than 0.1% in the electric welded boiler steel pipe using the ordinary boiler steel, and the area ratio of the ternary system mixed oxide of $SiO_2$, MnO and $Cr_2O_3$ must be not greater than 0.1% in the case of the electric welded boiler steel pipe using the low Cr ferrite type boiler steel. When the area ratio of the binary system mixed oxide or the ternary system mixed oxide exceeds 0.1%, the welding defect area ratio of the electric welded portion exceeds 0.1%, and both creep rupture strength and toughness drops. Therefore, the upper limit is limited to 0.1%

EXAMPLES

Steels having the chemical components shown in Tables 1 to 3 were molten in a 150 kg vacuum melting furnace and the resulting ingots were heated and hot rolled at 1,050 to 1,300° C. to obtain sheets having thickness of 3, 5, 10, 15 and 20 mm. All the hot rolling finish temperatures were controlled so that they fell within the range of 900 to 1,000° C. Next, solid solution heat treatment was conducted as the heat treatment for all the steels, and a tempering treatment at 780° C. for 1 hour with air-cooling was conducted. The properties of the base metal and electric welded portion of each steel after the heat treatment were evaluated by the creep rupture test, the Charpy impact test and the measurement of the welding defect area ratio. In this case, the electric welded portion fracture oxide form, etc, did not change before and after the tempering treatment of each test specimen used for the welding defect area ratio measurement.

Incidentally, a tensile test specimen of ϕ6 mm×GL 30 mm was used for the creep rupture test in the evaluation test. The creep rupture test was conducted for 15,000 hours at the longest at 550° C. and 600° C., and the creep rupture strength at 550° C. and 600° C. for 100,000 hours was calculated by extrapolation. A 2 mm V-notch test specimen (JIS4 test specimen) of 10 mm×10 mm×55 mm was used for the Charpy impact test, and a ductile-brittle fracture transition temperature (vTrs) was determined. The welding defect area ratio was measured by an optical microscope using the test specimen subjected to the Charpy test at 100° C.

Tables 1 and 2 show the chemical components of the steels according to the present invention and their evaluation results. Table 3 shows the chemical components of the Comparative Steels and their evaluation results. It can be understood that the steels (Nos. 1 to 84) of the present invention were superior to the Comparative Examples (Nos. 101 to 126) in all properties.

In the Comparative Steels Nos. 105, 109, 113, 121 and 125, the steam oxidation resistance of the steels was not sufficient when the Si content was less than 0.01%, and when the Si content exceeded 1.0%, toughness dropped remarkably, and such a Si content was detrimental to creep rupture strength.

In the Comparative Steels Nos. 106, 110, 114, 115, 118, 122 and 126, it was necessary to add at least 0.10% of Mn to obtain a sufficient strength, and when the Mn content exceeded 2.0%, creep rupture strength dropped in some cases.

In the Comparative Steels Nos. 103, 107, 115, 119 and 123, Cr was the indispensable element for improving the oxidation resistant and the high-temperature resistance of the low Cr ferrite steel. If the Cr content was less than 0.5%, these effects could not be obtained. When the Cr content exceeded 3.5%, on the other hand, toughness, weldability and heat conductivity became lower, so that the advantages of the low Cr ferrite steel became smaller.

In the Comparative Steels Nos. 102, 104, 108, 112, 116, 120, 123, 124 and 125, when the value (Si %)/(Mn % +Cr %) was less than 0.005%, oxides such as MnO and $Cr_2O_3$ remained at the electric welded portion and resulted in the welding defects. Also, the properties of the weld portion such as strength and toughness got deteriorated. When the value (Si %)/(Mn %+Cr %) exceeded 1.5%, the $SiO_2$ oxide remained at the electric welded portion and resulted in the welding defects with the result that the properties of the weld portion such as strength and toughness were deteriorated.

In the Comparative Steels Nos. 101, 116, 117, 123, 124 and 126, when the C content was less than 0.01%, precipitation of the carbides became insufficient and the amount of δ-ferrite became so great that strength and toughness were spoiled. When the C content exceeded 0.20%, on the other hand, the carbides precipitated excessively, and the steels were hardened remarkably. In consequence, both formability and weldability were deteriorated.

TABLE 1

Chemical component of present steels (wt %) and Evaluation result

| steel No. | C | Si | Mn | P | S | Cr | Mo | W | Nb | V | Cu | Ni | Co | Ti |
|---|---|---|---|---|---|---|---|---|---|---|---|---|---|---|
| 1 | 0.012 | 0.014 | 0.119 | 0.023 | 0.009 | | | | | | | | | |
| 2 | 0.198 | 0.980 | 1.946 | 0.026 | 0.008 | | | | | | | | | |
| 3 | 0.011 | 0.015 | 0.110 | 0.019 | 0.006 | 0.522 | | | | | | | | |
| 4 | 0.189 | 0.990 | 1.950 | 0.007 | 0.004 | 3.480 | | | | | | | | |
| 5 | 0.161 | 0.753 | 0.100 | 0.009 | 0.002 | 2.378 | 0.013 | | 0.015 | 0.025 | | | | |
| 6 | 0.111 | 0.150 | 0.120 | 0.008 | 0.007 | | 1.022 | | 0.015 | 0.300 | | | | |
| 7 | 0.032 | 0.992 | 0.223 | 0.025 | 0.007 | 0.521 | 1.466 | | 0.314 | 0.550 | | | | |
| 8 | 0.063 | 0.493 | 0.790 | 0.006 | 0.004 | 1.429 | 1.008 | | 0.249 | 0.217 | | | | |
| 9 | 0.124 | 0.709 | 1.263 | 0.030 | 0.003 | 2.964 | | 1.526 | 0.222 | 0.102 | | | | |
| 10 | 0.195 | 0.256 | 1.302 | 0.019 | 0.010 | 0.500 | | 0.012 | 0.194 | 0.992 | | | | |
| 11 | 0.056 | 0.555 | 0.316 | 0.017 | 0.003 | 3.231 | | 2.523 | 0.492 | 0.843 | | | | |
| 12 | 0.097 | 0.432 | 1.998 | 0.015 | 0.007 | 1.705 | 1.374 | 3.000 | 0.001 | 0.249 | | | | |
| 13 | 0.148 | 0.014 | 0.286 | 0.017 | 0.002 | 2.262 | 0.065 | 0.864 | 0.080 | 0.512 | | | | |
| 14 | 0.189 | 0.248 | 1.552 | 0.011 | 0.008 | 3.492 | 0.486 | 1.222 | 0.155 | 0.197 | | | | |
| 15 | 0.010 | 0.047 | 0.864 | 0.023 | 0.003 | 2.665 | 2.000 | 2.792 | 0.332 | 0.341 | | | | |
| 16 | 0.158 | 0.022 | 0.109 | 0.030 | 0.009 | 2.964 | 0.012 | | 0.223 | 0.024 | | | | 0.001 |
| 17 | 0.031 | 0.860 | 0.260 | 0.026 | 0.006 | 3.496 | 1.666 | | 0.193 | 0.993 | | | | 0.033 |
| 18 | 0.062 | 0.012 | 1.256 | 0.022 | 0.005 | 0.502 | 1.027 | | 0.493 | 0.342 | | | | 0.046 |
| 19 | 0.122 | 0.651 | 0.205 | 0.023 | 0.010 | 1.555 | | 1.592 | 0.016 | 0.192 | | | | 0.009 |
| 20 | 0.191 | 0.894 | 1.440 | 0.016 | 0.003 | 2.231 | | 1.230 | 0.088 | 0.522 | | | | 0.025 |
| 21 | 0.055 | 0.112 | 0.212 | 0.007 | 0.002 | 1.429 | | 2.764 | 0.337 | 0.243 | | | | 0.050 |
| 22 | 0.095 | 0.931 | 0.223 | 0.028 | 0.002 | 0.751 | 1.026 | 0.843 | 0.194 | 0.843 | | | | 0.013 |
| 23 | 0.145 | 0.843 | 0.614 | 0.007 | 0.002 | 2.989 | 0.064 | 3.000 | 0.153 | 0.103 | | | | 0.027 |
| 24 | 0.185 | 0.992 | 0.234 | 0.025 | 0.009 | 0.531 | 0.444 | 2.610 | 0.284 | 0.216 | | | | 0.016 |
| 25 | 0.010 | 0.346 | 1.992 | 0.011 | 0.005 | 0.854 | 1.992 | 0.011 | 0.316 | 0.555 | | | | 0.024 |
| 26 | 0.155 | 0.021 | 0.106 | 0.030 | 0.005 | 2.875 | 0.012 | | 0.219 | 0.022 | 0.10 | | | |
| 27 | 0.031 | 0.817 | 0.265 | 0.011 | 0.006 | 3.486 | 1.633 | | 0.189 | 0.998 | 0.86 | | | |
| 28 | 0.061 | 0.011 | 1.281 | 0.015 | 0.008 | 0.511 | 1.006 | | 0.498 | 0.315 | | 1.99 | | |
| 29 | 0.119 | 0.618 | 0.209 | 0.028 | 0.010 | 1.508 | | 1.496 | 0.002 | 0.177 | | 0.54 | | |
| 30 | 0.194 | 0.849 | 1.469 | 0.026 | 0.004 | 2.164 | | 1.156 | 0.086 | 0.480 | | | 0.12 | |
| 31 | 0.054 | 0.106 | 0.216 | 0.025 | 0.003 | 1.386 | | 2.598 | 0.330 | 0.224 | | | 0.62 | |
| 32 | 0.093 | 0.884 | 0.227 | 0.020 | 0.008 | 0.728 | 1.005 | 0.792 | 0.190 | 0.776 | 1.53 | 1.23 | | |
| 33 | 0.142 | 0.801 | 0.626 | 0.013 | 0.006 | 2.899 | 0.063 | 2.994 | 0.150 | 0.095 | 0.35 | | 0.98 | |
| 34 | 0.182 | 0.982 | 0.239 | 0.019 | 0.005 | 0.515 | 0.435 | 2.453 | 0.278 | 0.199 | | 0.11 | 1.98 | |
| 35 | 0.010 | 0.329 | 1.992 | 0.024 | 0.005 | 0.828 | 1.952 | 0.010 | 0.310 | 0.511 | 2.00 | 1.52 | 1.51 | |
| 36 | 0.010 | 0.020 | 1.515 | 0.025 | 0.003 | 2.818 | 0.012 | | 0.214 | 0.021 | 1.98 | | | 0.001 |
| 37 | 0.026 | 0.801 | 0.301 | 0.030 | 0.005 | 3.493 | 1.600 | | 0.185 | 0.999 | 0.84 | | | 0.032 |
| 38 | 0.126 | 0.011 | 0.593 | 0.015 | 0.006 | 0.501 | 0.986 | | 0.499 | 0.305 | | 0.11 | | 0.045 |
| 39 | 0.020 | 0.606 | 1.167 | 0.026 | 0.006 | 1.478 | | 1.526 | 0.002 | 0.171 | | 1.99 | | 0.009 |
| 40 | 0.144 | 0.832 | 1.989 | 0.020 | 0.008 | 2.121 | | 1.179 | 0.085 | 0.466 | | | 1.98 | 0.025 |

TABLE 1-continued

| Chemical component of present steels (wt %) and Evaluation result | | | | | | | | | | | | | |
|---|---|---|---|---|---|---|---|---|---|---|---|---|---|
| 41 | 0.021 | 0.104 | 0.527 | 0.018 | 0.009 | 1.358 | | 2.650 | 0.324 | 0.217 | | 0.11 | 0.049 |

| steel No. | B | N | Al | O | others | SMC | 550 CRS MPa | 600 CRS MPa | vTrs ° C. | welding defect area ratio % |
|---|---|---|---|---|---|---|---|---|---|---|
| 1 | | | | 0.016 | | 0.118 | 155 | 98 | −30 | 0.058 |
| 2 | | | | 0.008 | | 0.504 | 153 | 96 | −49 | 0.020 |
| 3 | | | | 0.009 | | 0.024 | 155 | 98 | −30 | 0.058 |
| 4 | | | | 0.012 | | 0.182 | 153 | 96 | −48 | 0.022 |
| 5 | 0.0003 | 0.051 | 0.009 | 0.020 | | 0.304 | 154 | 97 | −45 | 0.027 |
| 6 | 0.0050 | 0.008 | 0.009 | 0.013 | | 1.250 | 159 | 100 | −45 | 0.028 |
| 7 | 0.0100 | 0.031 | 0.009 | 0.013 | | 1.333 | 163 | 103 | −42 | 0.034 |
| 8 | 0.0051 | 0.019 | 0.001 | 0.009 | | 0.222 | 159 | 100 | −40 | 0.037 |
| 9 | 0.0084 | 0.014 | 0.010 | 0.001 | | 0.168 | 159 | 100 | −50 | 0.018 |
| 10 | 0.0024 | 0.064 | 0.003 | 0.002 | | 0.142 | 155 | 98 | −51 | 0.016 |
| 11 | 0.0016 | 0.072 | 0.004 | 0.004 | | 0.158 | 157 | 99 | −36 | 0.046 |
| 12 | 0.0031 | 0.031 | 0.005 | 0.008 | | 0.117 | 160 | 101 | −42 | 0.034 |
| 13 | 0.0059 | 0.026 | 0.002 | 0.009 | | 0.005 | 157 | 99 | −50 | 0.019 |
| 14 | 0.0004 | 0.001 | 0.002 | 0.015 | | 0.049 | 155 | 98 | −48 | 0.021 |
| 15 | 0.0066 | 0.080 | 0.001 | 0.013 | | 0.013 | 164 | 103 | −37 | 0.045 |
| 16 | 0.0003 | 0.053 | 0.009 | 0.012 | | 0.007 | 154 | 97 | −45 | 0.028 |
| 17 | 0.0100 | 0.034 | 0.008 | 0.016 | | 0.229 | 164 | 103 | −42 | 0.034 |
| 18 | 0.0065 | 0.016 | 0.005 | 0.013 | | 0.007 | 160 | 101 | −42 | 0.035 |
| 19 | 0.0005 | 0.015 | 0.002 | 0.010 | | 0.370 | 155 | 98 | −42 | 0.035 |
| 20 | 0.0062 | 0.062 | 0.003 | 0.007 | | 0.244 | 157 | 99 | −54 | 0.009 |
| 21 | 0.0035 | 0.071 | 0.001 | 0.015 | | 0.068 | 158 | 100 | −38 | 0.042 |
| 22 | 0.0017 | 0.034 | 0.010 | 0.009 | | 0.956 | 158 | 100 | −40 | 0.038 |
| 23 | 0.0022 | 0.025 | 0.009 | 0.020 | | 0.234 | 156 | 99 | −46 | 0.027 |
| 24 | 0.0081 | 0.001 | 0.006 | 0.010 | | 1.297 | 160 | 101 | −56 | 0.007 |
| 25 | 0.0055 | 0.080 | 0.006 | 0.016 | | 0.122 | 162 | 102 | −35 | 0.047 |
| 26 | 0.0003 | 0.055 | 0.009 | 0.020 | | 0.007 | 154 | 97 | −45 | 0.028 |
| 27 | 0.0098 | 0.035 | 0.008 | 0.013 | | 0.218 | 164 | 103 | −42 | 0.034 |
| 28 | 0.0064 | 0.016 | 0.005 | 0.017 | | 0.006 | 156 | 98 | −12 | 0.095 |
| 29 | 0.0005 | 0.015 | 0.002 | 0.009 | | 0.360 | 154 | 97 | −33 | 0.051 |
| 30 | 0.0061 | 0.064 | 0.003 | 0.016 | | 0.234 | 157 | 99 | −54 | 0.009 |
| 31 | 0.0034 | 0.073 | 0.001 | 0.019 | | 0.066 | 158 | 100 | −38 | 0.042 |
| 32 | 0.0017 | 0.035 | 0.010 | 0.011 | | 0.925 | 155 | 98 | −22 | 0.075 |
| 33 | 0.0022 | 0.026 | 0.009 | 0.007 | | 0.227 | 157 | 99 | −45 | 0.027 |
| 34 | 0.0079 | 0.001 | 0.006 | 0.014 | | 1.303 | 160 | 101 | −53 | 0.011 |
| 35 | 0.0054 | 0.079 | 0.006 | 0.013 | | 0.117 | 160 | 101 | −13 | 0.093 |
| 36 | 0.0003 | 0.053 | 0.009 | 0.015 | | 0.005 | 155 | 98 | −30 | 0.057 |
| 37 | 0.0099 | 0.034 | 0.008 | 0.015 | | 0.211 | 164 | 103 | −41 | 0.035 |
| 38 | 0.0062 | 0.016 | 0.005 | 0.019 | | 0.010 | 159 | 100 | −46 | 0.026 |
| 39 | 0.0005 | 0.015 | 0.002 | 0.008 | | 0.229 | 152 | 96 | −2 | 0.115 |
| 40 | 0.0060 | 0.063 | 0.003 | 0.020 | | 0.203 | 158 | 100 | −49 | 0.019 |
| 41 | 0.0034 | 0.072 | 0.001 | 0.014 | | 0.055 | 158 | 100 | −34 | 0.049 |

SMC: (Si %)/(Mn % + Cr %) value
550 CRS: estimated creep rupture strength at 550° C. for 100,000 hrs.
600 CRS: estimated creep rupture strength at 600° C. for 100,000 hrs.

TABLE 2

| Chemical component of present steels (wt %) and Evaluation result | | | | | | | | | | | | | | |
|---|---|---|---|---|---|---|---|---|---|---|---|---|---|---|
| steel No. | C | Si | Mn | P | S | Cr | Mo | W | Nb | V | Cu | Ni | Co | Ti |
| 42 | 0.022 | 0.955 | 0.222 | 0.027 | 0.010 | 0.610 | 0.985 | 0.808 | 0.186 | 0.752 | 1.50 | 0.29 | | 0.013 |
| 43 | 0.061 | 0.785 | 1.393 | 0.021 | 0.005 | 2.841 | 0.061 | 3.000 | 0.147 | 0.092 | 0.34 | | 1.52 | 0.026 |
| 44 | 0.023 | 0.999 | 1.779 | 0.016 | 0.010 | 0.505 | 0.426 | 2.502 | 0.273 | 0.193 | | 1.62 | 0.83 | 0.016 |
| 45 | 0.195 | 0.322 | 0.101 | 0.016 | 0.006 | 0.812 | 1.984 | 0.011 | 0.303 | 0.495 | 0.10 | 0.94 | 0.54 | 0.024 |
| 46 | 0.160 | 0.751 | 0.100 | 0.008 | 0.001 | 2.377 | 0.013 | | 0.014 | 0.024 | | | | |
| 47 | 0.031 | 0.990 | 0.222 | 0.024 | 0.006 | 0.520 | 1.466 | | 0.313 | 0.549 | | | | |
| 48 | 0.062 | 0.491 | 0.789 | 0.005 | 0.003 | 1.428 | 1.008 | | 0.248 | 0.216 | | | | |
| 49 | 0.123 | 0.707 | 1.262 | 0.029 | 0.002 | 2.963 | | 1.526 | 0.221 | 0.101 | | | | |
| 50 | 0.194 | 0.254 | 1.301 | 0.018 | 0.009 | 0.500 | | 0.012 | 0.193 | 0.991 | | | | |
| 51 | 0.055 | 0.553 | 0.315 | 0.016 | 0.002 | 3.230 | | 2.523 | 0.491 | 0.842 | | | | |
| 52 | 0.096 | 0.430 | 1.997 | 0.014 | 0.006 | 1.704 | 1.374 | 3.000 | 0.001 | 0.248 | | | | |
| 53 | 0.147 | 0.012 | 0.285 | 0.016 | 0.001 | 1.861 | 0.065 | 0.864 | 0.079 | 0.511 | | | | |
| 54 | 0.188 | 0.246 | 1.551 | 0.010 | 0.007 | 3.491 | 0.486 | 1.222 | 0.154 | 0.196 | | | | |
| 55 | 0.010 | 0.045 | 0.863 | 0.022 | 0.002 | 2.664 | 2.000 | 2.792 | 0.331 | 0.340 | | | | |
| 56 | 0.157 | 0.020 | 0.108 | 0.029 | 0.008 | 2.963 | 0.012 | | 0.222 | 0.023 | | | | 0.001 |

TABLE 2-continued

Chemical component of present steels (wt %) and Evaluation result

| | | | | | | | | | | | | | | |
|---|---|---|---|---|---|---|---|---|---|---|---|---|---|---|
| 57 | 0.030 | 0.858 | 0.259 | 0.025 | 0.005 | 3.495 | 1.666 | | 0.192 | 0.992 | | | | 0.033 |
| 58 | 0.061 | 0.010 | 1.255 | 0.021 | 0.004 | 0.501 | 1.027 | | 0.492 | 0.341 | | | | 0.046 |
| 59 | 0.121 | 0.649 | 0.204 | 0.022 | 0.009 | 1.554 | | 1.592 | 0.015 | 0.191 | | | | 0.009 |
| 60 | 0.190 | 0.892 | 1.439 | 0.015 | 0.002 | 2.230 | | 1.230 | 0.087 | 0.521 | | | | 0.025 |
| 61 | 0.054 | 0.110 | 0.211 | 0.006 | 0.001 | 1.428 | | 2.764 | 0.336 | 0.242 | | | | 0.050 |
| 62 | 0.094 | 0.929 | 0.222 | 0.027 | 0.001 | 0.750 | 1.026 | 0.843 | 0.193 | 0.842 | | | | 0.013 |
| 63 | 0.144 | 0.841 | 0.613 | 0.006 | 0.001 | 2.988 | 0.064 | 3.000 | 0.152 | 0.102 | | | | 0.027 |
| 64 | 0.184 | 0.990 | 0.233 | 0.024 | 0.008 | 0.530 | 0.444 | 2.610 | 0.283 | 0.215 | | | | 0.016 |
| 65 | 0.010 | 0.344 | 1.991 | 0.010 | 0.004 | 0.853 | 1.992 | 0.011 | 0.315 | 0.554 | | | | 0.024 |
| 66 | 0.154 | 0.019 | 0.105 | 0.029 | 0.004 | 2.874 | 0.012 | | 0.218 | 0.021 | 0.10 | | | |
| 67 | 0.030 | 0.815 | 0.264 | 0.010 | 0.005 | 3.485 | 1.633 | | 0.188 | 0.997 | 0.86 | | | |
| 68 | 0.060 | 0.010 | 1.280 | 0.014 | 0.007 | 0.510 | 1.006 | | 0.497 | 0.314 | | 1.99 | | |
| 69 | 0.118 | 0.616 | 0.208 | 0.027 | 0.009 | 1.507 | | 1.496 | 0.001 | 0.176 | | 0.54 | | |
| 70 | 0.193 | 0.847 | 1.468 | 0.025 | 0.003 | 2.163 | | 1.156 | 0.085 | 0.479 | | | 0.12 | |
| 71 | 0.053 | 0.104 | 0.215 | 0.024 | 0.002 | 1.385 | | 2.598 | 0.329 | 0.223 | | | 0.62 | |
| 72 | 0.092 | 0.882 | 0.226 | 0.019 | 0.007 | 0.727 | 1.005 | 0.792 | 0.189 | 0.775 | 1.53 | 1.23 | | |
| 73 | 0.141 | 0.799 | 0.625 | 0.012 | 0.005 | 2.898 | 0.063 | 2.994 | 0.149 | 0.094 | 0.35 | | 0.98 | |
| 74 | 0.181 | 0.980 | 0.238 | 0.018 | 0.004 | 0.514 | 0.435 | 2.453 | 0.277 | 0.198 | | 0.11 | 1.98 | |
| 75 | 0.010 | 0.327 | 1.991 | 0.023 | 0.004 | 0.827 | 1.952 | 0.010 | 0.309 | 0.510 | 2.00 | 1.52 | 1.51 | |
| 76 | 0.010 | 0.018 | 1.514 | 0.024 | 0.002 | 1.817 | 0.012 | | 0.213 | 0.020 | 1.98 | | | 0.001 |
| 77 | 0.025 | 0.799 | 0.300 | 0.029 | 0.004 | 3.492 | 1.600 | | 0.184 | 0.998 | 0.84 | | | 0.032 |
| 78 | 0.125 | 0.010 | 0.592 | 0.014 | 0.005 | 0.500 | 0.986 | | 0.498 | 0.304 | | 0.11 | | 0.045 |
| 79 | 0.019 | 0.604 | 1.166 | 0.025 | 0.005 | 1.477 | | 1.526 | 0.001 | 0.170 | | 1.99 | | 0.009 |
| 80 | 0.143 | 0.830 | 1.988 | 0.019 | 0.007 | 2.120 | | 1.179 | 0.084 | 0.465 | | | 1.98 | 0.025 |
| 81 | 0.020 | 0.102 | 0.526 | 0.017 | 0.008 | 1.357 | | 2.650 | 0.323 | 0.216 | | | 0.11 | 0.049 |
| 82 | 0.021 | 0.953 | 0.221 | 0.026 | 0.009 | 0.609 | 0.985 | 0.808 | 0.185 | 0.751 | 1.50 | 0.29 | | 0.013 |
| 83 | 0.060 | 0.783 | 1.392 | 0.020 | 0.004 | 2.840 | 0.061 | 3.000 | 0.146 | 0.091 | 0.34 | | 1.52 | 0.026 |
| 84 | 0.022 | 0.997 | 1.778 | 0.015 | 0.009 | 0.504 | 0.426 | 2.502 | 0.272 | 0.192 | | 1.62 | 0.83 | 0.016 |
| 85 | 0.194 | 0.320 | 0.100 | 0.015 | 0.005 | 0.811 | 1.984 | 0.011 | 0.302 | 0.494 | 0.10 | 0.94 | 0.54 | 0.024 |

| steel No. | B | N | Al | O | others | SMC | 550 CRS MPa | 600 CRS MPa | vTrs ° C. | welding defect area ratio % |
|---|---|---|---|---|---|---|---|---|---|---|
| 42 | 0.0016 | 0.034 | 0.010 | 0.016 | | 1.148 | 158 | 100 | −29 | 0.081 |
| 43 | 0.0021 | 0.025 | 0.009 | 0.013 | | 0.185 | 158 | 100 | −37 | 0.043 |
| 44 | 0.0078 | 0.001 | 0.006 | 0.012 | | 0.437 | 158 | 100 | −15 | 0.088 |
| 45 | 0.0053 | 0.079 | 0.006 | 0.009 | | 0.353 | 159 | 100 | −40 | 0.039 |
| 46 | 0.0003 | 0.050 | 0.008 | 0.019 | La = 0.001 | 0.303 | 156 | 98 | −46 | 0.025 |
| 47 | 0.0099 | 0.030 | 0.008 | 0.012 | Ca = 0.001 | 1.334 | 165 | 104 | −43 | 0.032 |
| 48 | 0.0050 | 0.018 | 0.000 | 0.008 | Y = 0.002 | 0.221 | 161 | 102 | −41 | 0.036 |
| 49 | 0.0083 | 0.013 | 0.009 | 0.000 | Ce = 0.001 | 0.167 | 161 | 101 | −51 | 0.017 |
| 50 | 0.0023 | 0.063 | 0.002 | 0.001 | Zr = 0.002 | 0.141 | 157 | 99 | −52 | 0.015 |
| 51 | 0.0015 | 0.071 | 0.003 | 0.003 | Ta = 0.001 | 0.156 | 159 | 100 | −37 | 0.044 |
| 52 | 0.0030 | 0.030 | 0.004 | 0.007 | Hf = 0.001 | 0.116 | 162 | 102 | −43 | 0.033 |
| 53 | 0.0058 | 0.025 | 0.001 | 0.008 | Re = 0.002 | 0.006 | 159 | 100 | −51 | 0.017 |
| 54 | 0.0003 | 0.001 | 0.001 | 0.014 | Pt = 0.002 | 0.049 | 157 | 99 | −49 | 0.020 |
| 55 | 0.0065 | 0.079 | 0.000 | 0.012 | Ir = 0.001 | 0.013 | 166 | 105 | −38 | 0.043 |
| 56 | 0.0003 | 0.052 | 0.008 | 0.011 | Pd = 0.002 | 0.007 | 156 | 98 | −46 | 0.026 |
| 57 | 0.0099 | 0.033 | 0.007 | 0.015 | Sb = 0.002 | 0.229 | 166 | 104 | −43 | 0.032 |
| 58 | 0.0064 | 0.015 | 0.004 | 0.012 | La = 0.17 | 0.006 | 162 | 102 | −42 | 0.033 |
| 59 | 0.0004 | 0.014 | 0.001 | 0.009 | Ca = 0.19 | 0.369 | 157 | 99 | −42 | 0.033 |
| 60 | 0.0061 | 0.061 | 0.002 | 0.006 | Y = 0.2 | 0.243 | 159 | 100 | −55 | 0.008 |
| 61 | 0.0034 | 0.070 | 0.000 | 0.014 | Ce = 0.18 | 0.067 | 160 | 101 | −39 | 0.040 |
| 62 | 0.0016 | 0.033 | 0.009 | 0.008 | Zr = 0.16 | 0.958 | 160 | 101 | −41 | 0.036 |
| 63 | 0.0021 | 0.024 | 0.008 | 0.019 | Ta = 0.15 | 0.234 | 158 | 100 | −47 | 0.025 |
| 64 | 0.0080 | 0.001 | 0.005 | 0.009 | Hf = 0.18 | 1.298 | 162 | 102 | −56 | 0.005 |
| 65 | 0.0054 | 0.079 | 0.005 | 0.015 | Re = 0.2 | 0.121 | 164 | 103 | −36 | 0.045 |
| 66 | 0.0003 | 0.054 | 0.008 | 0.019 | Pt = 0.18 | 0.006 | 156 | 98 | −46 | 0.027 |
| 67 | 0.0097 | 0.034 | 0.007 | 0.012 | Ir = 0.2 | 0.217 | 166 | 104 | −43 | 0.033 |
| 68 | 0.0063 | 0.015 | 0.004 | 0.016 | Pd = 0.17 | 0.006 | 158 | 100 | −12 | 0.093 |
| 69 | 0.0004 | 0.014 | 0.001 | 0.008 | Sb = 0.19 | 0.359 | 156 | 98 | −34 | 0.050 |
| 70 | 0.0060 | 0.063 | 0.002 | 0.015 | La = 0.05, Ca = 0.12 | 0.233 | 159 | 100 | −55 | 0.007 |
| 71 | 0.0033 | 0.072 | 0.000 | 0.018 | Y = 0.08, Ce = 0.003 | 0.065 | 160 | 101 | −39 | 0.041 |
| 72 | 0.0016 | 0.034 | 0.009 | 0.010 | Zr = 0.12, Ta = 0.008 | 0.925 | 157 | 99 | −22 | 0.073 |
| 73 | 0.0021 | 0.025 | 0.008 | 0.006 | Hf = 0.009, Re = 0.12 | 0.227 | 159 | 100 | −46 | 0.026 |
| 74 | 0.0078 | 0.001 | 0.005 | 0.013 | Pt = 0.009, Ir = 0.11 | 1.304 | 162 | 102 | −54 | 0.010 |
| 75 | 0.0053 | 0.078 | 0.005 | 0.012 | Pd = 0.005, Sb = 0.1 | 0.116 | 162 | 102 | −13 | 0.091 |
| 76 | 0.0003 | 0.052 | 0.008 | 0.014 | Zr = 0.13, Ir = 0.012 | 0.006 | 157 | 99 | −31 | 0.055 |
| 77 | 0.0098 | 0.033 | 0.007 | 0.014 | Ca = 0.13, Y = 0.005 | 0.211 | 166 | 104 | −42 | 0.033 |
| 78 | 0.0061 | 0.015 | 0.004 | 0.018 | Ca = 0.18, Ta = 0.18 | 0.009 | 161 | 102 | −47 | 0.024 |
| 79 | 0.0004 | 0.014 | 0.001 | 0.007 | Re = 0.011, Sb = 0.002 | 0.229 | 154 | 97 | −2 | 0.113 |
| 80 | 0.0059 | 0.062 | 0.002 | 0.019 | La = 0.005, Ca = 0.12, Ta = 0.16 | 0.202 | 160 | 101 | −50 | 0.018 |
| 81 | 0.0033 | 0.071 | 0.000 | 0.013 | Y = 0.16, Zr = 0.16, Ta = 0.11 | 0.054 | 160 | 101 | −35 | 0.047 |

TABLE 2-continued

| Chemical component of present steels (wt %) and Evaluation result | | | | | | | | | | |
|---|---|---|---|---|---|---|---|---|---|---|
| 82 | 0.0015 | 0.033 | 0.009 | 0.015 | Ca = 0.16, Zr = 0.11, Hf = 0.008 | 1.148 | 160 | 101 | −29 | 0.059 |
| 83 | 0.0020 | 0.024 | 0.008 | 0.012 | Ca = 0.008, Ta = 0.16, Pt = 0.013 | 0.185 | 160 | 101 | −38 | 0.042 |
| 84 | 0.0077 | 0.001 | 0.005 | 0.011 | La = 0.015, Ca = 0.12, Y = 0.018, Zr = 0.11 | 0.437 | 160 | 101 | −16 | 0.087 |
| 85 | 0.0052 | 0.078 | 0.005 | 0.008 | Ca = 0.005, Zr = 0.2, Pd = 0.005, Sb = 0.008 | 0.351 | 161 | 101 | −41 | 0.037 |

SMC: (Si %)/(Mn % + Cr %) value
550 CRS: estimated creep rupture value at 550° C. for 100,000 hrs.
600 CRS: estimated creep rupture value at 600° C. for 100,000 hrs.

TABLE 3

Chemical components of Comparative Steels (wt %) and evaluation result

| steel No. | C | Si | Mn | P | S | Cr | Mo | W | Nb | V | Cu | Ni | Co | Ti |
|---|---|---|---|---|---|---|---|---|---|---|---|---|---|---|
| 101 | 0.006 | 0.562 | 1.230 | 0.009 | 0.009 | | | | | | | | | |
| 102 | 0.053 | 0.721 | 0.460 | 0.012 | 0.004 | | | | | | | | | |
| 103 | 0.120 | 0.777 | 0.109 | 0.008 | 0.010 | 3.569 | | | | | | | | |
| 104 | 0.051 | 0.986 | 0.111 | 0.023 | 0.003 | 0.511 | | | | | | | | |
| 105 | 0.161 | 1.232 | 0.326 | 0.009 | 0.002 | 2.641 | 0.013 | | 0.015 | 0.025 | | | | |
| 106 | 0.124 | 0.709 | 0.061 | 0.030 | 0.003 | 2.964 | | 1.526 | 0.222 | 0.102 | | | | |
| 107 | 0.010 | 0.047 | 0.864 | 0.023 | 0.003 | 0.294 | 2.000 | 2.792 | 0.332 | 0.341 | | | | |
| 108 | 0.158 | 0.013 | 0.109 | 0.030 | 0.009 | 2.964 | 0.012 | | 0.223 | 0.024 | | | | 0.001 |
| 109 | 0.122 | 0.008 | 0.205 | 0.023 | 0.010 | 0.632 | | 1.592 | 0.016 | 0.192 | | | | 0.009 |
| 110 | 0.152 | 0.931 | 2.614 | 0.028 | 0.002 | 0.751 | 1.026 | 0.843 | 0.194 | 0.843 | | | | 0.013 |
| 111 | 0.155 | 0.864 | 0.106 | 0.030 | 0.005 | 3.864 | 0.012 | | 0.219 | 0.022 | 0.10 | | | |
| 112 | 0.025 | 0.984 | 0.110 | 0.015 | 0.008 | 0.511 | 1.548 | | 0.498 | 0.942 | | 1.99 | | |
| 113 | 0.119 | 1.164 | 0.209 | 0.028 | 0.010 | 0.613 | | 1.496 | 0.003 | 0.177 | | 0.54 | | |
| 114 | 0.064 | 0.123 | 0.084 | 0.025 | 0.003 | 3.214 | | 2.222 | 0.357 | 0.547 | | | 0.62 | |
| 115 | 0.149 | 0.884 | 2.666 | 0.020 | 0.008 | 0.124 | 1.005 | 0.792 | 0.190 | 0.776 | 1.53 | 1.23 | | |
| 116 | 0.864 | 0.016 | 1.989 | 0.013 | 0.006 | 3.492 | 0.236 | 2.994 | 0.147 | 0.321 | 0.35 | | 0.98 | |
| 117 | 0.202 | 0.096 | 1.222 | 0.019 | 0.005 | 1.114 | 0.197 | 0.497 | 0.258 | 0.048 | | 0.11 | 1.98 | |
| 118 | 0.154 | 0.424 | 2.222 | 0.024 | 0.005 | 1.097 | 0.649 | 0.397 | 0.487 | 0.095 | 2.00 | 1.52 | 1.51 | |
| 119 | 0.010 | 0.847 | 1.515 | 0.025 | 0.003 | 3.995 | 0.012 | | 0.214 | 0.021 | 1.98 | | | 0.001 |
| 120 | 0.195 | 0.964 | 0.111 | 0.015 | 0.006 | 0.501 | 1.517 | | 0.499 | 0.914 | | 0.11 | | 0.025 |
| 121 | 0.020 | 1.694 | 1.167 | 0.026 | 0.006 | 0.601 | | 1.526 | 0.003 | 0.171 | | 1.99 | | 0.009 |
| 122 | 0.068 | 0.079 | 0.064 | 0.020 | 0.008 | 2.222 | | 2.487 | 0.022 | 0.369 | | | 1.98 | 0.005 |
| 123 | 0.261 | 0.955 | 0.222 | 0.027 | 0.010 | 0.412 | 0.985 | 0.808 | 0.186 | 0.752 | 1.50 | 0.29 | | 0.013 |
| 124 | 0.436 | 0.016 | 1.994 | 0.021 | 0.005 | 3.489 | 0.231 | 3.000 | 0.144 | 0.311 | 0.34 | | 1.52 | 0.033 |
| 125 | 0.121 | 0.006 | 1.980 | 0.016 | 0.010 | 1.092 | 0.193 | 0.507 | 0.253 | 0.047 | | 1.62 | 0.83 | 0.018 |
| 126 | 0.218 | 0.416 | 2.954 | 0.016 | 0.006 | 1.075 | 1.984 | 0.405 | 0.477 | 0.092 | 0.10 | 0.94 | 0.54 | 0.046 |

| steel No. | B | N | Al | O | SMC | 550 CRS MPa | 600 CRS MPa | vTrs ° C. | welding defect area ratio % |
|---|---|---|---|---|---|---|---|---|---|
| 101 | | | | 0.019 | 0.457 | 112 | 60 | 13 | 0.780 |
| 102 | | | | 0.016 | 1.567 | 102 | 56 | 62 | 3.472 |
| 103 | | | | 0.012 | 0.211 | 123 | 78 | 10 | 0.775 |
| 104 | | | | 0.008 | 1.585 | 111 | 55 | 20 | 1.100 |
| 105 | 0.0003 | 0.051 | 0.009 | 0.020 | 0.415 | 123 | 77 | 6 | 0.495 |
| 106 | 0.0084 | 0.014 | 0.010 | 0.001 | 0.234 | 127 | 80 | 11 | 0.865 |
| 107 | 0.0066 | 0.080 | 0.009 | 0.013 | 0.041 | 131 | 83 | 0 | 0.198 |
| 108 | 0.0003 | 0.053 | 0.005 | 0.012 | 0.004 | 123 | 78 | 6 | 0.471 |
| 109 | 0.0005 | 0.015 | 0.008 | 0.010 | 0.010 | 124 | 78 | 3 | 0.207 |
| 110 | 0.0017 | 0.034 | 0.010 | 0.009 | 0.277 | 126 | 79 | 7 | 0.547 |
| 111 | 0.0003 | 0.055 | 0.005 | 0.020 | 0.218 | 123 | 78 | 6 | 0.446 |
| 112 | 0.0063 | 0.061 | 0.009 | 0.017 | 1.585 | 126 | 80 | 30 | 2.472 |
| 113 | 0.0005 | 0.015 | 0.008 | 0.009 | 1.416 | 123 | 78 | 6 | 0.442 |
| 114 | 0.0034 | 0.031 | 0.001 | 0.019 | 0.037 | 126 | 80 | 0 | 0.123 |
| 115 | 0.0017 | 0.035 | 0.010 | 0.011 | 0.317 | 124 | 78 | 12 | 0.928 |
| 116 | 0.0008 | 0.051 | 0.009 | 0.007 | 0.003 | 120 | 75 | 77 | 5.818 |
| 117 | 0.0016 | 0.003 | 0.008 | 0.014 | 0.041 | 124 | 78 | 10 | 0.795 |
| 118 | 0.0049 | 0.079 | 0.007 | 0.013 | 0.128 | 125 | 78 | 10 | 0.981 |
| 119 | 0.0003 | 0.053 | 0.005 | 0.015 | 0.154 | 124 | 78 | 9 | 0.678 |
| 120 | 0.0062 | 0.060 | 0.009 | 0.019 | 1.576 | 128 | 81 | 14 | 1.130 |
| 121 | 0.0005 | 0.015 | 0.008 | 0.008 | 0.958 | 122 | 77 | 52 | 2.854 |
| 122 | 0.0036 | 0.009 | 0.005 | 0.020 | 0.035 | 127 | 80 | 0 | 0.326 |
| 123 | 0.0016 | 0.034 | 0.010 | 0.016 | 1.506 | 124 | 78 | 13 | 0.853 |

TABLE 3-continued

| Chemical components of Comparative Steels (wt %) and evaluation result | | | | | | | | | |
|---|---|---|---|---|---|---|---|---|---|
| 124 | 0.0008 | 0.050 | 0.009 | 0.013 | 0.003 | 123 | 78 | 34 | 2.670 |
| 125 | 0.0016 | 0.003 | 0.008 | 0.012 | 0.002 | 122 | 77 | 21 | 1.598 |
| 126 | 0.0048 | 0.079 | 0.007 | 0.009 | 0.103 | 127 | 80 | 2 | 0.189 |

SMC: (Si %)/(Mn % + Cr %) value
550 CRS: estimated creep rupture strength at 550° C. for 100,000 hrs.
600 CRS: estimated creep rupture strength at 600° C. for 100,000 hrs.

Industrial Applicability

As described above, the present invention can produce a boiler steel, for use in a high-temperature high-pressure environment, that is excellent in creep rupture strength and electric weldability, and an electric welded boiler steel pipe having excellent properties of the electric welded portion. Since these materials are economical materials that can be produced at a low cost of production, the present invention makes great contributions to the development of the industry.

What is claimed is:

1. An electric welded boiler steel pipe having fewer defects at electric welded portions and excellent in creep rupture strength and toughness, containing, in terms of wt %:

C: 0.01 to 0.20w,

Si: 0.01 to 1.0%,

Mn: 0.10 to 2.0%, and

Cr: 0.5 to 3.5%; limiting the following elements:

P: to not greater than 0.030%,

S: to not greater than 0.010%, and

O: to not greater than 0.020%;

wherein a weight ratio of Si, Mn and Cr ((Si %)/(Mn %+Cr %)) is from 0.005 to 1.5;

the balance Fe and unavoidable impurities;

an area ratio of a ternary system mixed oxide of $SiO_2$, MnO and $Cr_2O_3$ at the electric welded portion is not greater than 0.1%; and the melting point of the mixed oxide of $SiO_2$, MnO and $Cr_2O_3$ formed at electric welding is not higher than 1,600° C.

2. An electric welded boiler steel pipe having fewer defects at electric welded portions and excellent in creep rupture strength and toughness, containing, in terms of wt %:

C: 0.01 to 0.20%,

Si: 0.01 to 1.01,

Mn: 0.10 to 2.0%,

Cr: 0.5 to 3.5%,

Nb: 0.001 to 0.5%,

V: 0.02 to 1.0%,

N: 0.001 to 0.08%,

B: 0.0003 to 0.01%, and

Al: not greater than 0.01%; containing further at least one of the following elements:

Mo: 0.001 to 2.0%, and

W: 0.01 to 3.0%, and limiting the following elements:

P: to not greater than 0.030%,

S: to not greater than 0.010%, an d

O: to not greater than 0.020%;

wherein a weight ratio of Si, Mn and Cr ((Si %)/(Mn %+Cr %)) is from 0.005 to 1.5;

the balance Fe and unavoidable impurities;

an area ratio of a ternary system mixed oxide of $SiO_2$, MnO and $Cr_2O_3$ at the electric welded portion is not greater than 0.1%; and the melting point of the mixed oxide of $SiO_2$, MnO and $Cr_2O_3$ formed at electric welding is not higher than 1,600° C.

3. An electric welded boiler steel pipe having fewer defects and excellent in creep rupture strength and toughness, according to claim 2, which further contains, in terms of wt %:

Ti: 0.001 to 0.05%, as a base metal component.

4. An electric welded boiler steel pipe having fewer defects at electric welded portions and excellent in creep rupture strength and toughness, according to claim 1, which further contains, in terms of wt %, at least one of the following elements as a base metal component:

Cu: 0.1 to 2.0%,

Ni: 0.1 to 2.0%, and

Co: 0.1 to 2.0%.

5. An electric welded boiler steel pipe having fewer defects at electric welded portions and excellent in creep rupture strength and toughness, according to claim 1, which further contains, in terms of wt %:

Ti: 0.001 to 0.05%, as a base metal component, and contains further at least one of the following elements:

Cu: 0.1 to 2.0%,

Ni: 0.1 to 2.0%, and

Co: 0.1 to 2.0%.

6. An electric welded boiler steel pipe having fewer defects and excellent in creep rupture strength and toughness, according to any of claims 2 to 5 which further contains, in terms of wt %, 0.001 to 0.2% of at least one of La, Ca, Y, Ce, Zr, Ta, Hf, Re, Pt, Ir, Pd and Sb as a base metal component.

* * * * *